US006427650B1

(12) United States Patent
Cristiani et al.

(10) Patent No.: US 6,427,650 B1
(45) **Date of Patent: *Aug. 6, 2002**

(54) ELECTROMAGNETIC ACTUATOR FOR THE CONTROL OF THE VALVES OF AN INTERNAL COMBUSTION ENGINE

(75) Inventors: Marcello Cristiani, Imola; Domenico Cannone, Bologna; Nicola Morelli, Rende, all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/666,337

(22) Filed: Sep. 21, 2000

(30) Foreign Application Priority Data

Sep. 23, 1999 (IT) ..... B099A0509

(51) Int. Cl.[7] ..... F01L 9/04
(52) U.S. Cl. ..... 123/90.11; 123/90.41
(58) Field of Search ..... 123/90.11, 90.15, 123/90.39, 90.41, 90.61

(56) References Cited

U.S. PATENT DOCUMENTS 4,762,095 A * 8/1988 Mezger et al. ..... 123/90.11
5,161,494 A * 11/1992 Brown, Jr. ..... 123/90.11
5,772,179 A 6/1998 Morinigo et al. ..... 251/129.1

FOREIGN PATENT DOCUMENTS

| | | |
|---|---|---|
| DE | 196 28 860 | 1/1998 |
| DE | 197 14 412 | 10/1998 |
| EP | 0 245 614 | 11/1987 |
| EP | 0 405 187 | 1/1991 |
| WO | WO 98/42957 | 10/1998 |

* cited by examiner

*Primary Examiner*—Weilun Lo
(74) *Attorney, Agent, or Firm*—Arent Fox Kintner Plotkin & Kahn, PLLC

(57) ABSTRACT

An electromagnetic actuator for the control of the intake or exhaust valves of an internal combustion engine, in which an oscillating arm has a first end hinged on a fixed support and a second end in abutment, directly or via the interposition of a strut, on the upper end of the stem of the intake or exhaust valve, two electromagnets being provided in order to move, on command, the oscillating arm so as axially to displace the valve between a closed position and a position of maximum opening, a first and a second elastic member being provided to maintain the intake or exhaust valve respectively in the closed position and in the position of maximum opening, by exerting on the valve axial thrusts contrary to one another; in the balanced position, the two elastic members are adapted to maintain the valve in an intermediate position between the closed position and the position of maximum opening.

9 Claims, 5 Drawing Sheets

ELECTROMAGNETIC ACTUATOR FOR THE CONTROL OF THE VALVES OF AN INTERNAL COMBUSTION ENGINE

The present invention relates to an electromagnetic actuator for the control of the valves of an internal combustion engine.

BACKGROUND OF THE INVENTION

As is known, internal combustion engines are currently being tested in which the intake and exhaust valves which bring the combustion chamber of the engine selectively into communication respectively with the intake manifold and the exhaust manifold of the engine are actuated by electromagnetic actuators driven by an electronic control unit. This solution makes it possible to vary the lift, opening time and moment of opening and closing of the valves as a function of the angular velocity of the crankshaft and other operating parameters of the engine, thereby substantially improving its performance.

In FIG. 1, the electromagnetic actuator I which currently provides the best performance is disposed alongside the stem of the valve II of the internal combustion engine to be axially moved and comprises:

- an oscillating arm III of ferromagnetic material having a first end hinged on a fixed support IV so as to be able to oscillate bout a horizontal axis of rotation A perpendicular to the longitudinal axis of the valve II, and a second end connected via a hinge V to the upper end of the valve II of the engine to be axially moved;
- a pair of electromagnets VI disposed on opposite sides of the body of the oscillating arm III so as to be able to attract on command and alternatively the oscillating arm III, causing it to rotate about the axis of rotation A;
- and lastly an elastic member adapted to maintain the oscillating arm III in a rest position in which it is equidistant from the polar heads of the two electromagnets VI so as to maintain the valve II of the engine in an intermediate position between the closed position and the position of maximum opening that the valve II assumes when the oscillating arm III is disposed in contact with the polar head of the upper electromagnet VI and respectively with the polar head of the lower electromagnet VI.

The main drawback of the electromagnetic actuator I described and illustrated above is that the hinge V, as it has to be dimensioned to withstand, without the risk of breakage, propulsive mechanical stresses of substantial size (the oscillating arm III has to raise or lower the valve II in extremely short times), has a substantial weight and dimensions, substantially limiting the overall performance of the device. The mass of the hinge V in fact represents a considerable proportion of the overall mass of the moving parts.

The need to withstand, without the risk of breakage, propulsive mechanical stresses of substantial size, also makes it necessary, for the construction of the oscillating arm III and in particular the hinge V, to use particularly costly production processes and materials which have a major impact on the actuator's overall production costs.

SUMMARY OF THE INVENTION

The object of the present invention is to provide an electromagnetic actuator for the control of the valves of an internal combustion engine that is free from the above-mentioned drawbacks.

According to the present invention, there is provided an electromagnetic actuator for the control of the valves of an internal combustion engine which comprises at least one variable volume combustion chamber, at least one connection duct adapted to bring the combustion chamber into communication with atmosphere and at least one valve adapted to regulate the passage of fluids from and to the combustion chamber, wherein this valve is axially movable between a closed position in which it closes off the connection duct, and a position of maximum opening in which it enables the passage of fluids through the connection duct with the maximum admissible flow, and wherein the electromagnetic actuator comprises an oscillating arm having a first end hinged on a fixed support and a second end connected to the valve and a pair of electromagnets adapted to cause the oscillating arm to rotate on command in order axially to displace the valve between the closed position and the position of maximum opening, this electromagnetic actuator being characterised in that it comprises a first elastic member adapted to maintain the valve in the closed position, and in that the second end of the oscillating arm is disposed in abutment on the valve so as to be able to transmit only an axial thrust contrary to that of the first elastic member.

BRIEF DESCRIPTION OF THE DRAWINGS

The present invention will now be described with reference to the accompanying drawings, which show a non-limiting embodiment thereof, in which.

DETAILED DESCRIPTION OF THE INVENTION

Figure 1:
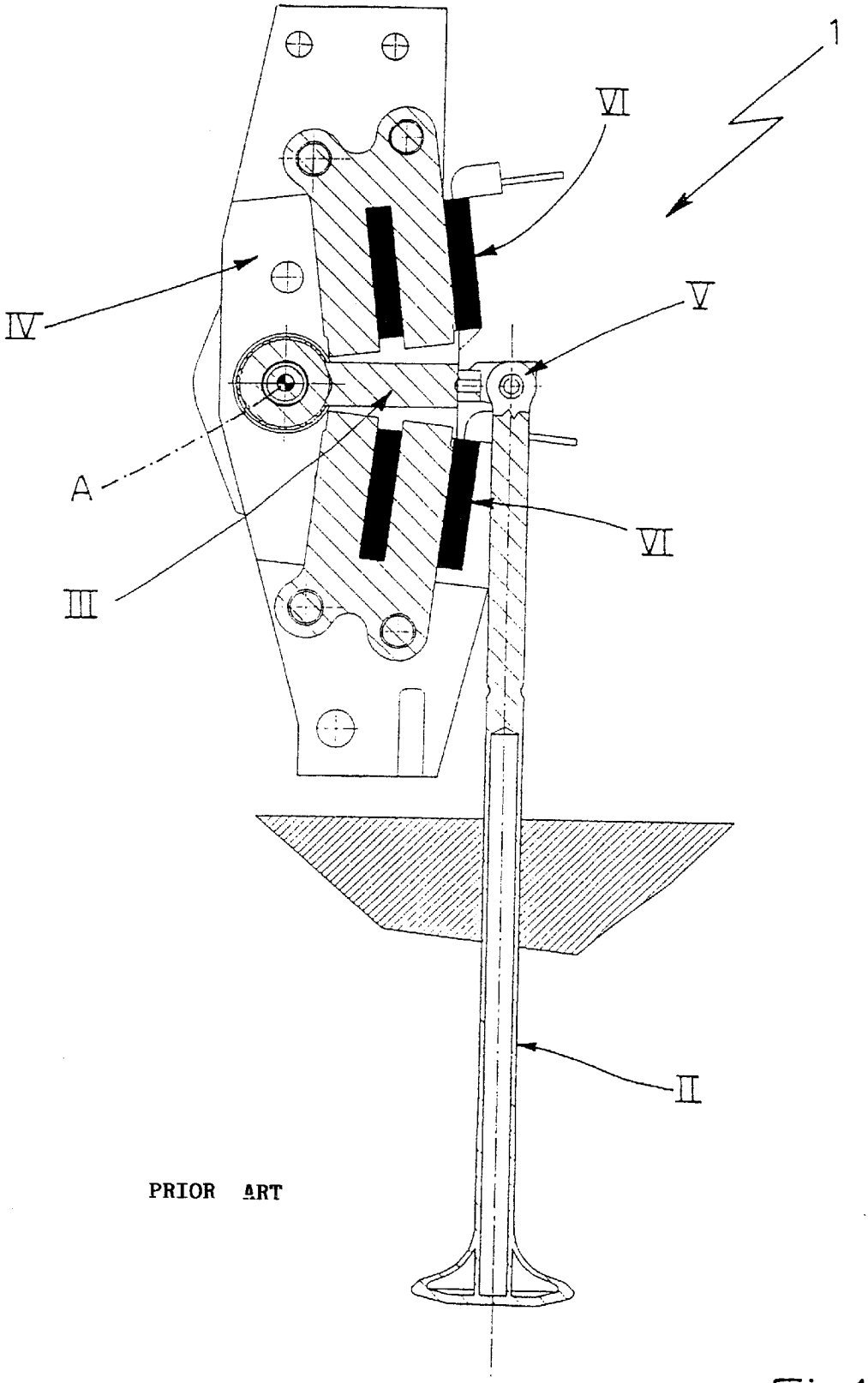
PRIOR ART Fig.1
FIG. 1 is a front view of a conventional electromagnetic actuator disposed alongside the stem of a valve of an internal combustion engine to be axially moved.
Figure 2:
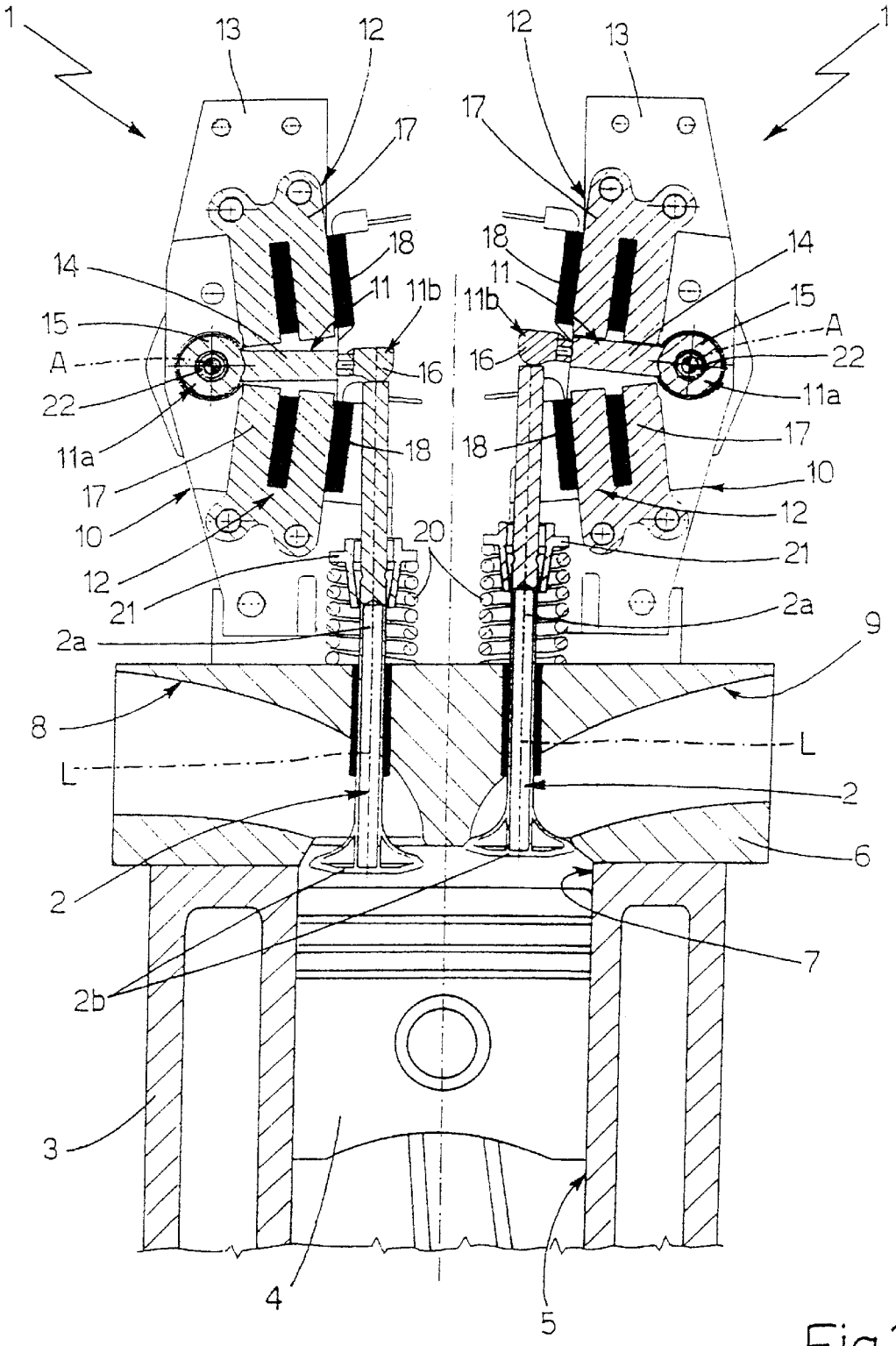
FIG. 2 is a front view, with some parts in cross-section and others removed for clarity, of an internal combustion engine provided with an electromagnetic actuator for the control of the valves of an internal combustion engine according to the present invention.

In FIG. 2, an electromagnetic actuator is shown overall by 1 and is adapted to displace on command at least one intake or exhaust valve 2 of an internal combustion engine which, in the embodiment illustrated, comprises a block 3, one or a plurality of pistons 4 mounted in an axially sliding manner in respective cylindrical cavities 5 obtained in the body of the block 3 and a head 6 disposed on the apex of the block 3 to close the cylindrical cavities 5.

Within the respective cylindrical cavity 5, each piston 4 bounds, together with the head 6, a variable volume combustion chamber 7, while the head 6 is provided, for each combustion chamber 7, with at least one intake duct 8 and at least one exhaust duct 9 adapted respectively to connect the combustion chamber 7 to the intake manifold and to the exhaust manifold of the internal combustion engine which are both of known type and are not therefore shown.

In FIG. 2, the internal combustion engine is lastly provided with a group of valves 2 adapted to regulate the flow of air into the combustion chamber 7 via the intake duct 8, and the discharge of the combusted gases from the combustion chamber 7 via the exhaust duct 9. In particular, the internal combustion engine has, at the inlet of each duct, whether the intake duct 8 or the exhaust duct 9, a respective mushroom valve 2 of known type, which is mounted on the head 6 so as to have its stem 2*a* sliding axially through the body of the head 6 and its own head 2*b* moving axially at the location of the inlet of the duct.

The valves 2 positioned at the in let of the intake ducts 8 are commonly called "intake valves" while the valves 2 positioned at the inlet of the exhaust ducts 9 are commonly called "exhaust valves".

Each valve 2, whether an "intake" or an "exhaust" valve, can move between a closed position in which it prevents gases from passing through the intake duct 8 or the exhaust duct 9 to and from the combustion chamber 7 of the internal combustion engine, and a position of maximum opening in which it enables gases to pass through the intake duct 8 or the exhaust duct 9 to and from this combustion chamber 7 with the maximum admissible flow.

Figure 3:
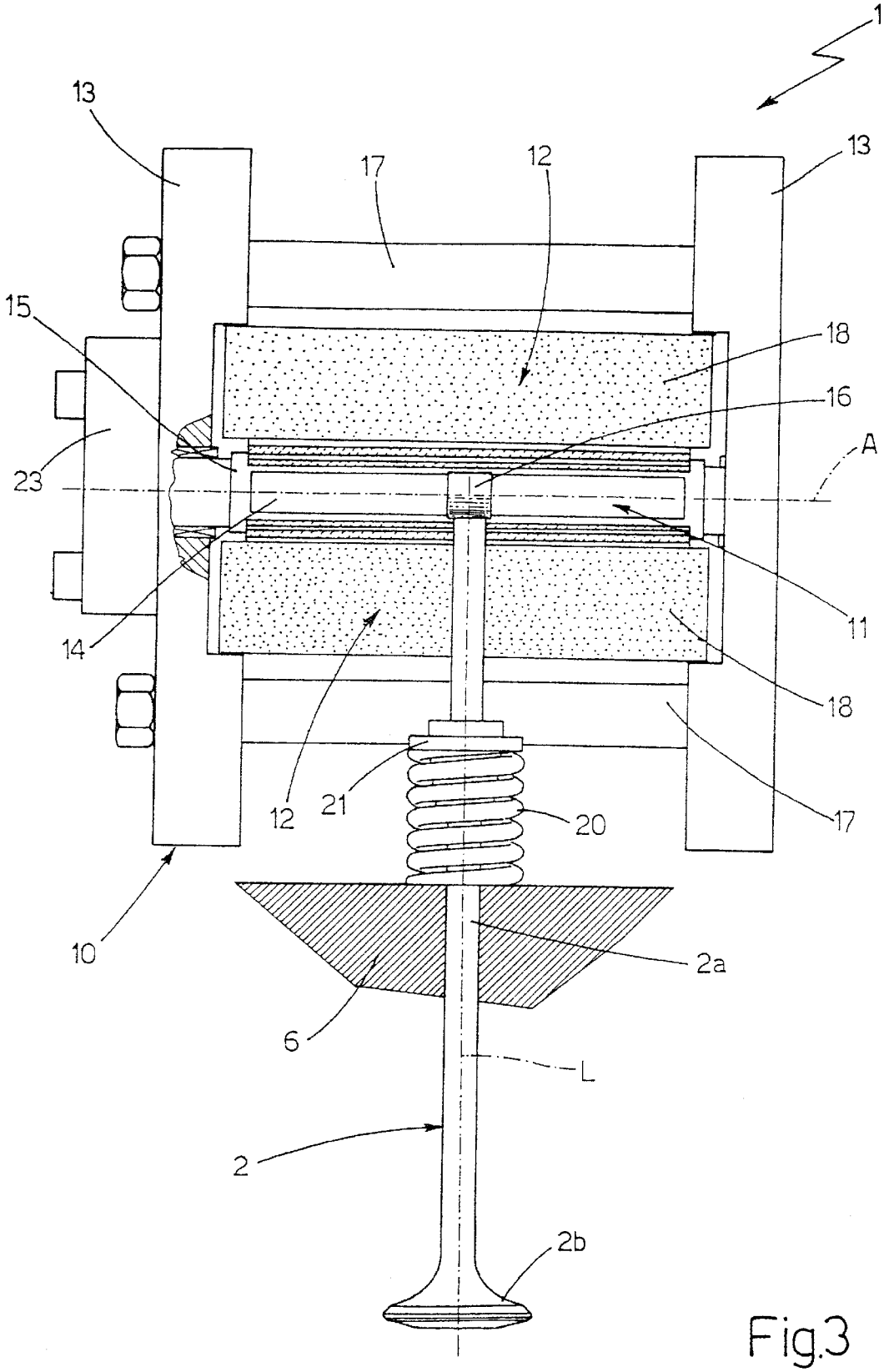
FIG. 3 is a front view of the electromagnetic actuator of FIG. 2.
Figure 4:
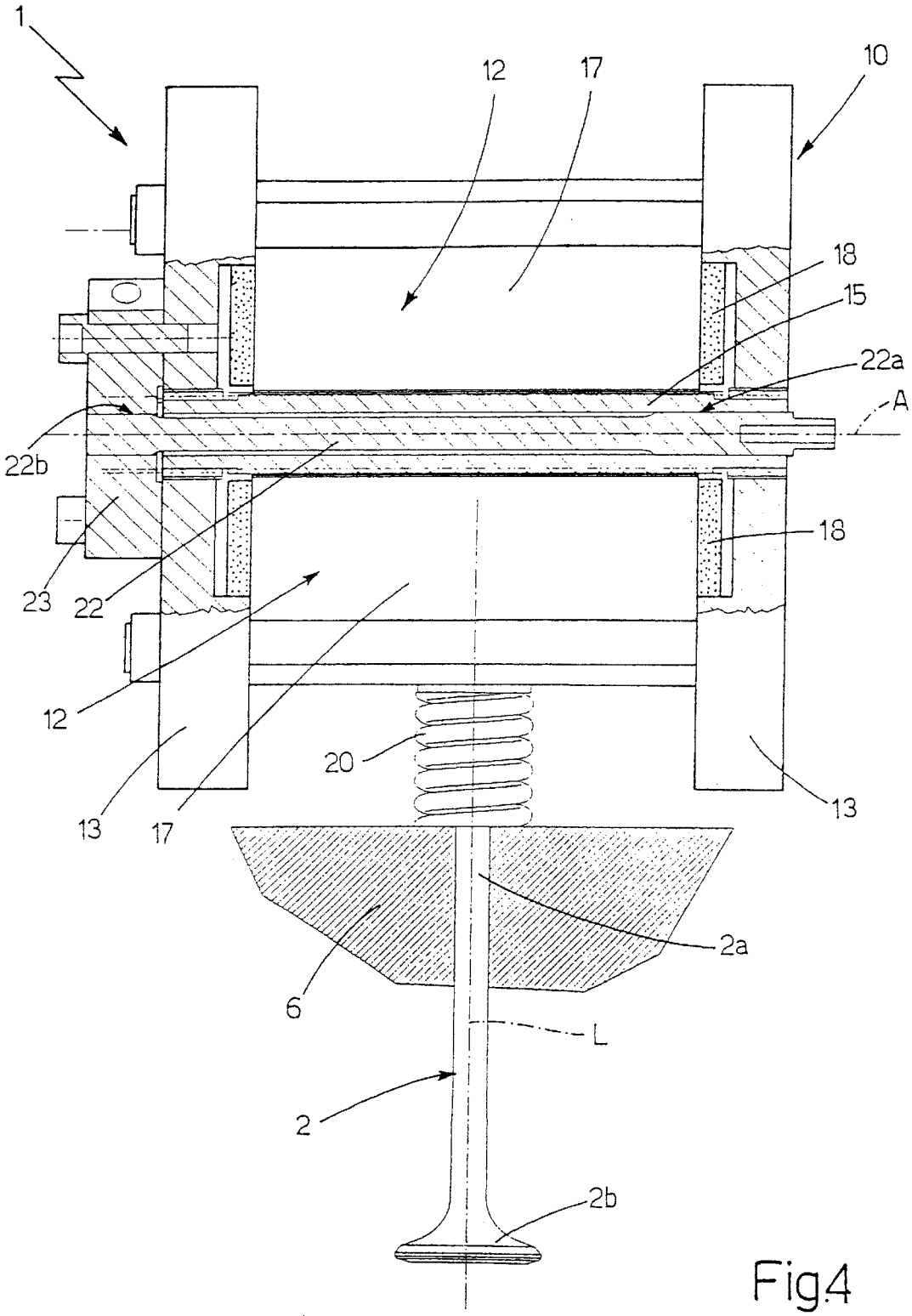
FIG. 4 is a rear view, with some parts in cross-section and others removed for clarity, of the electromagnetic actuator of FIG. 2.

In FIGS. 2, 3 and 4, the electromagnetic actuator 1 comprises a support frame 10 rigid with the head 6 of the internal combustion engine, an oscillating arm 11 of ferromagnetic material, having a first end 11*a* hinged on the support frame 10 so as to be able to oscillate about an axis of rotation A perpendicular to the longitudinal axis L of the valve 2, and a second end 11*b* disposed directly in abutment on the upper end of the stem 2*a* of the valve 2, and a pair of electromagnets 12 disposed one above the other on opposite sides of the central portion of the oscillating arm 11, so as to be able to attract on command and alternatively the oscillating arm 11, causing it to rotate about the axis of rotation A.

In the embodiment shown, the support frame 10 is formed by a pair of parallel plates 13 facing one another which extend in a projecting manner from the head 6 of the engine, laterally to the stem 2*a* of the valve 2 to be axially moved; the oscillating arm 11 is disposed between the plates 13 and is formed by a central plate 14 of ferromagnetic mate rial disposed in the space between the polar heads of the two electromagnets 12, by a cylindrical tubular member 15 rigid with a lateral edge of the central plate 14 and lastly by a projection 16 projecting from the central plate 14 on the side opposite the cylindrical tubular member 15.

With particular reference to FIGS. 2 and 4, the cylindrical tubular member 15 extend coaxially to the axis of rotation A, is mounted to rot ate on the plates 13 forming the support frame 10 by means of the interposition of roller bearings of known type, and defines the end 11*a* of the oscillating arm 11; the projection 16 is cam-shaped and is disposed directly in abutment on the upper end of the stem 2*a* of the valve 2, defining the end 11*b* of this oscillating arm 11.

Both of the electromagnets 12 are disposed between the plates 13 of the frame 10 and each, in the embodiment illustrated, comprises a U-shaped magnetic core 17 secured to the support frame 10 such that its two polar heads face the central plate 14, and a coil 18 of electrically conducting material fitted on this magnetic core 17. It will be appreciated that the magnetic core 17, to reduce hysteresis losses, is formed by a pack of sheets of ferromagnetic material held together by locking bolts mounted to pass through the plates 13.

With reference to FIGS. 2, 3 and 4, the electromagnetic actuator 1 lastly comprises two elastic members, one adapted to maintain the valve 2 in the closed position, and the other to hold the oscillating arm 11 in abutment on one of the two electromagnets 12, and in particular on that electromagnet 12 against which the oscillating arm 11 is normally caused to abut in order to position the valve 2 in the position of maximum opening.

In this case, the first elastic member of the electromagnetic actuator 1, designated hereafter by reference numeral 20, is formed by a helical spring keyed on the stem 2*a* of the valve 2 so as to have its first end abutting on the head 6 of the engine and its second end abutting on a stop member 21 secured to the stem 2*a* of this valve 2. The second elastic member of the electromagnetic actuator 1, designated hereafter by reference numeral 22, is formed, in the embodiment illustrated, by a torsion bar inserted partially into the cylindrical tubular member 15 so as to have its first end 22*a* angularly rigid with the cylindrical tubular member 15 and its second end 22*b* rigid with one of the plates 13 of the support frame 10 via a locking and adjustment member 23 provided thereon.

It will be appreciated that the two elastic members, i.e. the helical spring 20 and the torsion bar 22, oppose one another and that their elastic constants are selected so as to position, when the electromagnets 12 are both de-activated, i.e. in a balanced position, the oscillating arm 11 in a rest position in which this arm is substantially equidistant from the polar heads of the two electromagnets 12 so as to maintain the valve 2 of the engine in an intermediate position between the closed position and the position of maximum opening.

Figure 5:
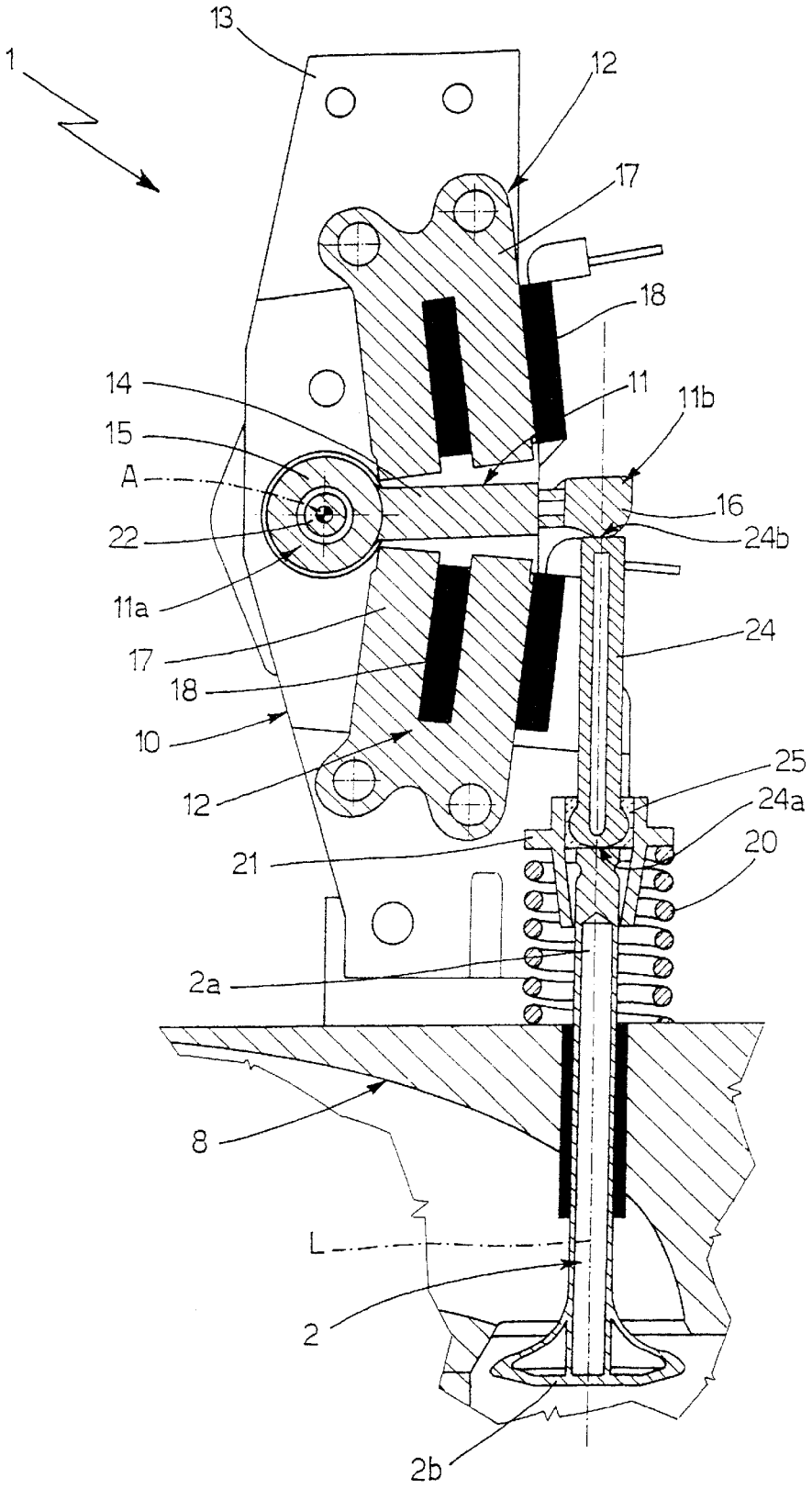
FIG. 5 is a front view, with some parts in cross-section and others removed for clarity, of a variant of the electromagnetic actuator of FIG. 2.

According to the variant shown in FIG. 5, the end 11*b* of the oscillating arm 11, i.e. the cam-shaped projection 16, is disposed in abutment on the upper end of the stem 2*a* of the valve 2 by means of the interposition of a mechanical member adapted to minimise the bending stresses to which the stem 2*a* of the valve 2 is subject during operation.

In this case, this mechanical member comprises a strut 24 interposed between the upper end of the stem 2*a* of the valve 2 and the end 11*b* of the oscillating arm 11 and an elastic joint 25 adapted to maintain this strut 24 rigid with the stem 2*a* of the valve 2. The strut 24 is formed by a rod 24 dimensioned to bear and transfer compression loads, which extends coaxially to the stem 2*a* of the valve 2 and has a first end 24*a* in abutment on the upper end of the stem 2*a* of the valve 2 and a second end 24*b* in abutment on the end 11*b* of the oscillating arm 11; the elastic joint 25 is positioned at the location of the upper end of the stem 2*a* of the valve 2, and is adapted to maintain the rod 24 coaxial to the stem 2*a* of the valve 2, with its end 24*a* always in abutment on the upper end of the stem 2*a* of the valve 2, thereby enabling small oscillations of this rod 24.

As the strut 24 is connected to the stem 2*a* of the valve 2 by means of the elastic joint 25, the mechanical stresses perpendicular to The stem 2*a* of the valve 2 generated by the friction of the end 11*b* of the oscillating arm 11 on the end 24*b* of the strut 24 exclusively cause oscillations of the strut 24 which are dampened and are not transmitted to the stem 2*a* of the valve 2.

It will be appreciated that, in the embodiment illustrated, the end 24*a* of the strut 24 has a hemispherical shape so as not to impede the oscillations of the strut 24 on the upper end of the stem 2*a* of the valve 2. The rod 24 may also be made in two pieces screwed together, so as to be able to adjust the axial length of the rod 24 in order to regulate the mechanical play.

The operation of the electromagnetic actuator 1 can be readily deduced from the above description and illustration: by supplying one or other of the two electromagnets 12 it is possible axially to move the valve 2 between the position of maximum opening, where the oscillating arm 11 is in abutment on the electromagnet 12 behind the head 6 and the closed position, where the oscillating arm 11 is in abutment on the upper electromagnet 12.

It will be appreciated that, in the electromagnetic actuator 1, the oscillating arm 11 acts on the upper end of the stem 2*a* of the valve 2 like a cam, exerting on this valve 2 solely a one-way axial thrust which, by overcoming the opposition of the helical spring 20, causes the displacement of the valve 2 towards the position of maximum opening. As regards, however, displacement from the position of maximum opening to the closed position, the axial thrust needed to displace the valve 2 is provided by the helical spring 20, while the oscillating arm 11 acts an elastic stop to control the return stroke of this valve 2.

The advantages deriving from the use of the electromagnetic actuator 1 described and illustrated above are evident: in the first place the overall mass of the moving components is substantially reduced with respect to the solutions currently in use, there is no hinge and the mechanical stresses to which the oscillating arm 11 is subject are substantially reduced making the production of the oscillating arm more economic.

A further advantage of the electromagnetic actuator 1 is that the axial movement of the valves 2 is in this case carried out using the elastic force of the two elastic members 20 and 22, i.e. the helical spring 20 and the torsion bar 22, with a substantial increase in performance with the same electrical power consumption. In this solution, the oscillating arm 11 guided by the two electromagnets 12 is limited to adding or subtracting its axial thrust with respect to that exerted by the torsion bar 22, so as to disturb the equilibrium between the helical spring 20 and the torsion bar 22 and thus to cause the displacement of the valve 2.

It will be appreciated that modifications and variations may be made to the electromagnetic actuator 1 described and illustrated above without thereby departing from the scope of the present invention.

What is claimed is:

1. An electromagnetic actuator (1) for the control of the valves (2) of an internal combustion engine comprising at least one variable volume combustion chamber (7), at least one connection duct (8, 9) adapted to bring the combustion chamber (7) into communication with atmosphere and at least one valve (2) adapted to regulate the passage of fluids from and to the combustion chamber (7), wherein the valve (2) is axially movable between a closed position in which the valve closes off the connection duct (8, 9), and a position of maximum opening in which the valve enables the passage of fluids through the connection duct (8, 9) with he maximum admissible flow, and wherein the electromagnetic actuator (1) comprises an oscillating arm (11) having a first end (11*a*) hinged on a fixed support (10) and a second end (11*b*) connected to the valve (2), and a pair of electromagnets (12) adapted to cause the oscillating arm (11) to rotate on command in order to axially displace the valve (2) between the closed position and the position of maximum opening, the electromagnetic actuator (1) being characterised in that the actuator comprises a fist elastic member (20) adapted to maintain the valve (2) in the closed position, and in that the second end (11*b*) of the oscillating arm (11) is disposed in abutment on the valve (2) so as to be able to transmit only an axial thrust contrary to that of the first elastic member (20), the electromagnetic actuator also comprises a strut (24) interposed between the second end (11*b*) of the oscillating arm (11) and the valve (2) of the internal combustion engine and an elastic joint (25) adapted to maintain the strut (24) rigid with the valve (2) of the internal combustion engine.

2. An electromagnetic actuator as claimed in claim 1, characterised in that the actuator comprises a second elastic member (22) adapted to maintain the valve (2) in the position of maximum opening, by exerting on the valve (2) an axial thrust contrary to that of the first elastic member (20).

3. An electromagnetic actuator as claimed in claim 2, characterised in that the first (20) and the second (22) elastic members are adapted to maintain, in the balanced position, the valve (2) in an intermediate position between the closed position and the position of maximum opening.

4. An electromagnetic actuator as claimed in claim 3, characterised in that the second elastic member (22) acts directly on the oscillating arm (11).

5. An electromagnetic actuator as claimed in claim 4, characterised in that the second elastic member (22) comprises a torsion bar (22) which has a first end (22*a*) rigid with the first end (11*a*) of the oscillating arm (11), and a second end (11*b*) rigid with the fixed support (10).

6. An electromagnetic actuator as claimed in claim 1, characterised in that the valve (2) is a mushroom valve mounted with a stem (2*a*) sliding axially through the head (6) of the internal combustion engine, and in that the first elastic member (20) comprises a helical spring (2) keyed on the stem (2*a*) of the valve (2) with a first end abutting on the head (6) of the engine and a second end abutting on a stop member (21) secured to the stem (2*a*) of the valve (2).

7. An electromagnetic actuator as claimed in claim 1, characterised in that the two electromagnets (12) are disposed on opposite sides of the oscillating arm (11).

8. An electromagnetic actuator as claimed in claim 7, characterised in that each of the electromagnets comprises a U-shaped magnetic core (17) secured to the fixed support (10) such that two polar heads of the magnetic core are facing the oscillating arm (11), and a coil (18) of electrically conducting material fitted on this magnetic core (17).

9. An electromagnetic actuator as claimed in claim 1, characterised in that the valve (2) of the internal combustion engine is a mushroom valve mounted with a stem (2*a*) sliding axially through the head (6) of the internal combustion engine, and in that the strut (24) is interposed between the second end (11*b*) of the oscillating arm (11) and the upper end of the stem (2*a*), the elastic joint (25) being adapted to maintain the strut (24) coaxial to the stem (2*a*) of the valve (2) with one end (24*a*) always in abutment on the upper end of the stem (2*a*).

* * * * *